US006347667B1

(12) United States Patent
Howlett et al.

(10) Patent No.: US 6,347,667 B1
(45) Date of Patent: Feb. 19, 2002

(54) WELL CLEAN-UP TOOL WITH IMPROVED CLEANING MEMBER

(75) Inventors: Paul David Howlett; Mark Carmichael, both of Aberdeen (GB)

(73) Assignee: Specialized Petroleum Services Ltd., Aberdeen (GB)

( * ) Notice: Subject to any disclaimer, the term of this patent is extended or adjusted under 35 U.S.C. 154(b) by 0 days.

(21) Appl. No.: 09/427,314

(22) Filed: Oct. 26, 1999

(51) Int. Cl.[7] ..... E21B 37/08
(52) U.S. Cl. ..... 166/311; 166/173; 166/177.3
(58) Field of Search ..... 166/311, 312, 166/173, 176, 177.3, 317

(56) References Cited

U.S. PATENT DOCUMENTS 3,861,465 A * 1/1975 Mignotte ..... 166/255
3,912,012 A 10/1975 Bush
4,221,264 A * 9/1980 Haggard ..... 166/177
4,580,635 A 4/1986 Radford et al.
4,893,684 A 1/1990 Alexander
5,069,285 A * 12/1991 Nuckols ..... 166/311
5,458,198 A * 10/1995 Hashemi et al. ..... 166/312

* cited by examiner

*Primary Examiner*—David Bagnell
*Assistant Examiner*—Zakiya Walker
(74) *Attorney, Agent, or Firm*—Ratner & Prestia

(57) ABSTRACT

Well cleaning apparatus comprises a tubular body member attached to a work string which supports one or more resilient and pliable cleaning members. Each cleaning member is provided with a means for allowing bypass as sized and adapted to wipe the well casing. In one embodiment, the apparatus may be used to plunge the well with the cleaning members providing the sealing relationship with the well casing.

5 Claims, 2 Drawing Sheets

WELL CLEAN-UP TOOL WITH IMPROVED CLEANING MEMBER

This invention relates to well cleaning apparatus and, more generally, to apparatus used for the cleaning of the insides of pipes, tubes, liners and the like.

It is considered desirable when drilling for oil or gas to maintain a clean interior in the casing or liner of the drilling well. For this purpose, well cleaning apparatus is well known and comes in a variety of different forms. One such type of well cleaning apparatus is generally known as a casing scraper. This type of tool typically incorporates steel casing scraper blades that scrape the inside of the casing or tubing in the well. A second type of well cleaning apparatus known in the art may be more accurately likened to a brush and incorporates cleaning pads with protruding bristles. Brushing tools are generally used to clean well casings, tubing and the like of smaller debris and or particles than that of scraper tools.

The present invention recognises that these and other clean up tools are not entirely satisfactory in cleaning all areas in well tubing. For example, where threads or joints exist, the inside surface of the tubing may be slightly irregular leading not only to increased entrapment of mud or debris, but the diminished accessibility of known clean up tools. Also, many well cleanup tools are not particularly suited to low tolerances in the tubing ovality.

An object of the present invention is to provide an alternative type of cleaning member on a clean-up tool used in well tubing and the like that provides improved penetration and cleaning in at least certain applications. From the description herein it will be seen that the invention provides other advantages over known art. For example, another disadvantage of the aforedescribed tools is that although they may be relatively efficient at removing particles from the casing wall, they do not necessarily prevent the debris from then remaining suspended in the well fluid even if the fluid is circulated through the well, not all of the debris is flushed out the surface. Thus, even where filters are provided to clean the well fluid, these may not be entirely effective as debris may remain suspended below the surface in the well.

In order to address this deficiency, other tools have been designed and manufactured which are intended to catch and/or trap the debris suspended in the circulation fluid. One example of this type of tool is described in our co-pending British Patent Application No 9806274.8. However, again while such tools mitigate the problem, they are not completely deficient and can also retard circulation in the well.

Accordingly, the present invention results from the additional recognition of a need to provide better apparatus and methodology for cleaning the annulus between a drilling string or work string and a casing string. Indeed, it is an object of the present invention to provide improved apparatus and method for cleaning casing string that is also adapted to clean the annulus between the work string and the casing string. Specifically, an object of the present invention is to remove suspended debris and particles from the aforedescribed annulus.

According to the present invention there is provided well cleaning apparatus comprising a tubular body member adapted for attachment to a work string, the body member supporting one or more resilient and pliable cleaning members biased in an outward radial direction to enable a generally planar surface of the or each cleaning member to contact the well casing or other tubing in use, the one or each cleaning member being made from a foam, polymeric or rubber material, and wherein the apparatus further includes bypass means for selectively enabling the circulation of fluid past the cleaning members when desired.

The cleaning member may be made from an elastomer and more specifically a thick walled polyurethane elastomer.

Preferably, the or each cleaning member is provided in the form of a cup that typically is positioned in a concave down orientation when the apparatus is suspended vertically in a well. Alternatively, the or each cleaning member may be an inflatable bladder.

The cleaning member may co-operate with the body member so as to create the said outward radial bias, in use. For example, the inflatable bladder may be suspended in compression during a cleaning operation between two portions of the body member.

Alternatively, the cleaning member may be formed with an inherent radial resilience that is maintained in radial compression in use.

Preferably, an abrasive and hard wearing surface is provided on the exterior of the cleaning member. Typically, the cleaning member would be manufactured as a composite, with the abrasive surface being adhered or welded to the outer surface of the cleaning member.

Preferably, the or each cleaning member sealably engages the inside wall of the casing or other tubing.

The bypass means may be provided as a rupturable disc or portion within the or each cleaning member. Alternatively, the by-pass means may be formed as a channel in the body member.

Also according to the present invention there is provided a well cleaning system comprising a tool having a tubular body member adapted for attachment to a work string, the body member supporting one or more resilient and pliable cleaning members biased in an outward radial direction to enable a generally planar surface of the or each cleaning member to sealably contact the well casing or other tubing in use, the one or each cleaning member being made from a foam, polymeric or rubber material, wherein the tool further includes bypass means for enabling the circulation of fluid past the cleaning members when desired, and means for closing said bypass, and the body member including a generally axial bore therethrough, wherein the bore communicates with a flow path to the surface of the well via the work string.

The apparatus may be associated with filtration means, that typically may be located at surface.

The apparatus may also be associated with vacuum or sucking means for providing suction of well fluid up the bore through the work string.

According to a second aspect of the invention herein there is provided a method of cleaning a well, the method including the step of running a work string into the well, the work string supporting one or more cleaning members adapted to plunge the well by sealably engaging the well casing such that the majority or substantially all of the well fluid below the one or more cleaning members is caused to flow up a bore or channel provided in the work string to surface.

The method may further include cleaning the well casing wall by the contact of the cleaning members thereon. The contact may be a scrubbing action.

The method may further include sucking the well fluid up the work string using a vacuum system or pump.

The method may further include filtering the well fluid, preferably at surface and thereafter directing the fluid back into the well.

The method may further include pressuring up behind the or each cleaning member so as to rupture a disc to enable fluid bypass after plunging the well.

In order to provide a better understanding of the invention, various embodiments thereof will now be described, by way of example only, and with reference to the following Figures, in which.

Figure 1:
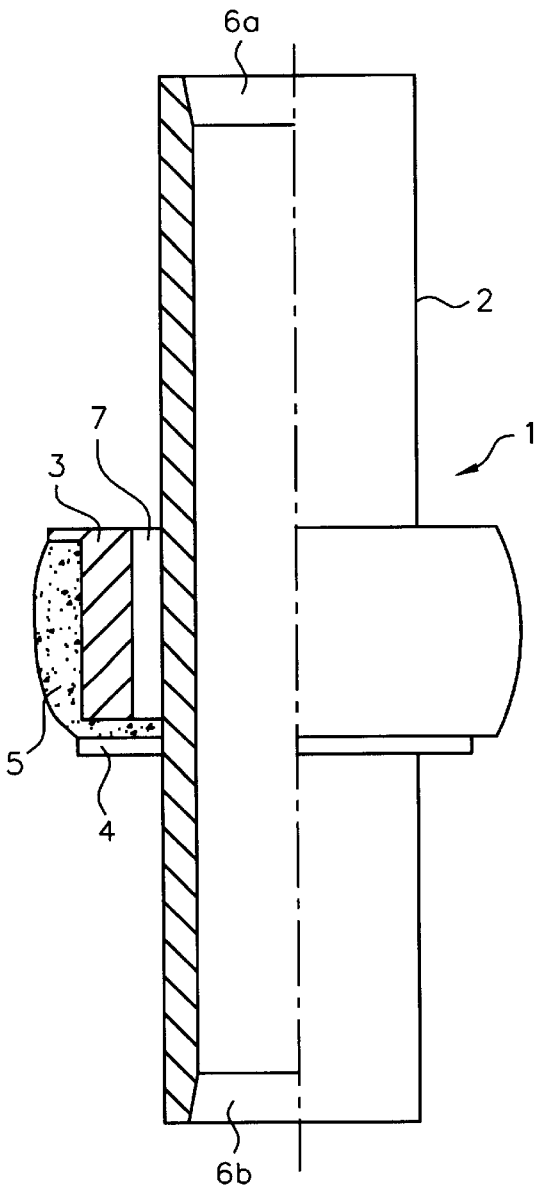
FIG. 1 shows a half sectional elevation of a first embodiment of a well cleanup tool incorporating the invention.

Referring firstly to FIG. 1, a relatively simple well cleanup tool is generally depicted at 1. The simple construction of the tool 1 is seen as a benefit in the commercial exploitation, construction and maintenance of the tool.

The tool 1 comprises a body member 2 supporting a sleeve 3. The sleeve 3 is moveable in a axial position relative to the body member 2 and is generally operable between a first position at which it substantially abuts a shoulder 4 on the body member 2 and a second position at which it it does not so abut the shoulder 4.

Bonded to the sleeve 3 is a cleaning member in the form of an inflatable bladder 5. The bladder is provided with a hard and robust surface coating and made of a suitably toughened fabric to avoid puncture or premature wear.

It is to be seen that when the sleeve is in the aforesaid first position, the bladder 5 is axially compressed and biased outwardly into contact with the casing wall (not shown). Conversely, when the sleeve 3 is in the second position, the bladder does not tend to bulge outwardly and thus is allowed to come out of contact with the casing. Thus the cleaning member 5 is able to expand and contract axially and therefore radially by co-operation of the sleeve 3 with the shoulder 4.

An advantage of this particular embodiment therefore is that it is possible to manipulate the tool 1 so that the cleaning member 5 does not contact the inner surface of the liner or other well tubing. This is desirable when, for example, the tool 1 is being retracted from the well and it would be detrimental to dislodge any further debris or mud.

Yet further, the axial expansion or contraction of the bladder 5 allows the degree of contact pressure of the cleaning member 5 on the well tubing to be manipulated to suit conditions. When the sleeve 3 is in the first position, the bladder 5 will be also be axially compressed and thus squeezed outwardly causing maximum contact and pressure of its cleaning surfaces on the inner surface of the well tubing. Raising the sleeve 3 slightly will reduce the pressure of inflation of the cleaning member 4 and this will therefore render the cleaning member more pliable, enabling it to better access any pits, grooves, threads or the like where debris may be trapped.

The body member 2 is attachable in a work string (not shown) by the provision of box threads 6*a* and 6*b*.

Fluid bypass is enabled through an annulus 7 formed between the sleeve 3 and the body member 2.

In the example embodiment illustrated in FIG. 1, the cleaning member 5 is made from a non-rigid and pliable polymer and inflated with air. If beneficial, an inflation tool (not shown) may be located in the body member 2 or sleeve 3 communicating with the inside of the inflatable compartment that is the cleaning member.

However, perhaps the most significant advantage of this feature of the first described embodiment is that a clean-up tool of this design can be used to clean a diverse range of tube diameters, without the need for the adjustment or replacement of parts. The pliable nature of the bag like cleaning member is adapted to conform to or adopt the internal diameter of the tubing, simply through the appropriate manipulation of the sleeve 3.

Figure 2:
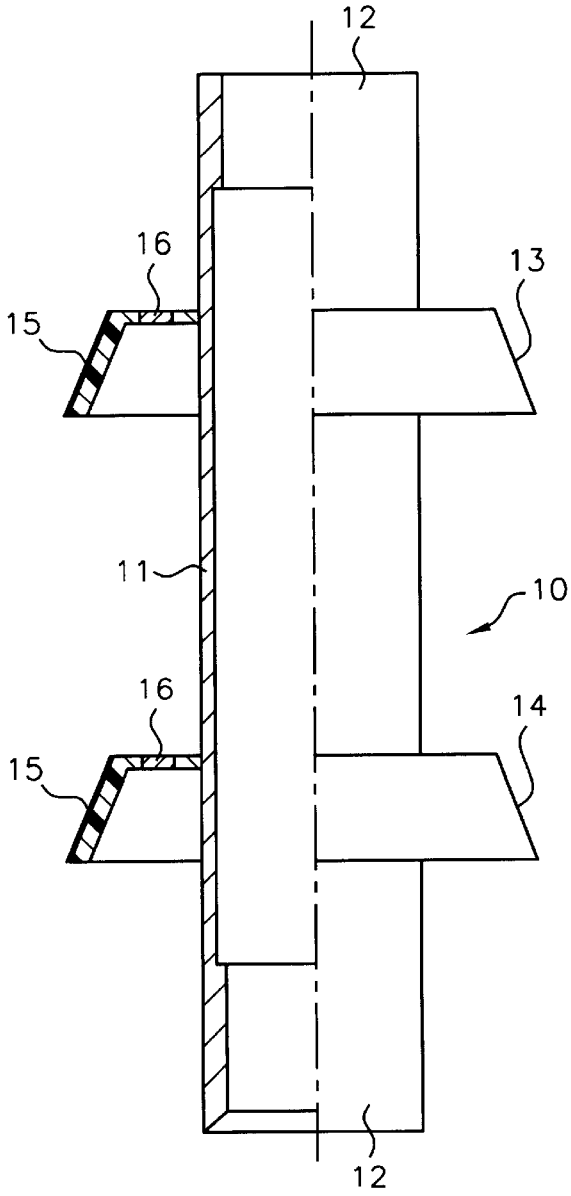
FIG. 2 shows an alternative embodiment of well cleanup tool.

Turning now to FIG. 2, an alternative cleanup tool is shown and generally depicted at 10. The tool 10 is again provided with a generally axial and tubular body member 11 having means for attachment in a string at its axial extremities 12.

The body member 11 carries two cup-shaped cleaning members 13,14 made from a semi-rigid plastics material and, specifically, coated polyurethane. The cups may be moulded in factory conditions and have excellent physical and chemical resistant properties.

In the embodiment shown, the cups 13,14 are both positioned with their open ends facing in a down-hole direction in order to reduce the dislodgement of debris when the tool 10 is being retracted out of the well. However, the invention is not to be construed as having this limitation and in an alternative embodiment the cups may each be provided in either a concave up or concave down orientation. Similarly any number of cups may be used.

The outer rims or walls 15 of the cups 13,14 may be coated with a hard wearing and abrasive material. This may be provided by incorporating abrasive particles into the material during moulding. Alternatively, as shown in FIG. 2, the cups 13,14 may be manufactured in a composite form, having an outer layer or ply with abrasive and wear resistant properties.

The outer walls or sides of the cups 13,14 are sized to be radially compressed by the well tubing walls in use. This ensures that they impart a suitable force to the surfaces to be cleaned, even when the walls of the cups begin to wear, thereby allowing for an aggressive cleaning operation.

The cups 13,14 are provided with rupture discs 16 which, when ruptured, allow for the circulation of fluid through the cups. Rupturing of the discs 16 may be accomplished by pressuring up above the cups to a predetermined rupture pressure.

It may be seen that a feature of the present invention is that the cleaning members used are generally adapted to present a planar surface and not of the type found in the art which present points or edges to the tubing to be cleaned. This allows for a much improved scrubbing action to be achieved. Moreover, this feature, coupled with the nature of the materials encompassed within the invention, provide increased coverage and access to remote or protected areas of the casing or liner.

The tool 10 may be used in the following way. Firstly it may be attached to the end of a work string or drill string and then run in a well. As it is lowered into the well, the cups 13,14 sealably press against the casing wall and as there is no bypass provided for circulation, the cups serve to plunge the well. Fluid in the well and importantly, and debris in the well fluid, is forced up the axial bore that runs through the tool body member 11 and then further up the work string to surface. Once this plunging of the well has been completed, the fluid above the cleaning members may be pressurised to a sufficient extent to rupture the discs 16, thereby enabling circulation.

Figure 3:
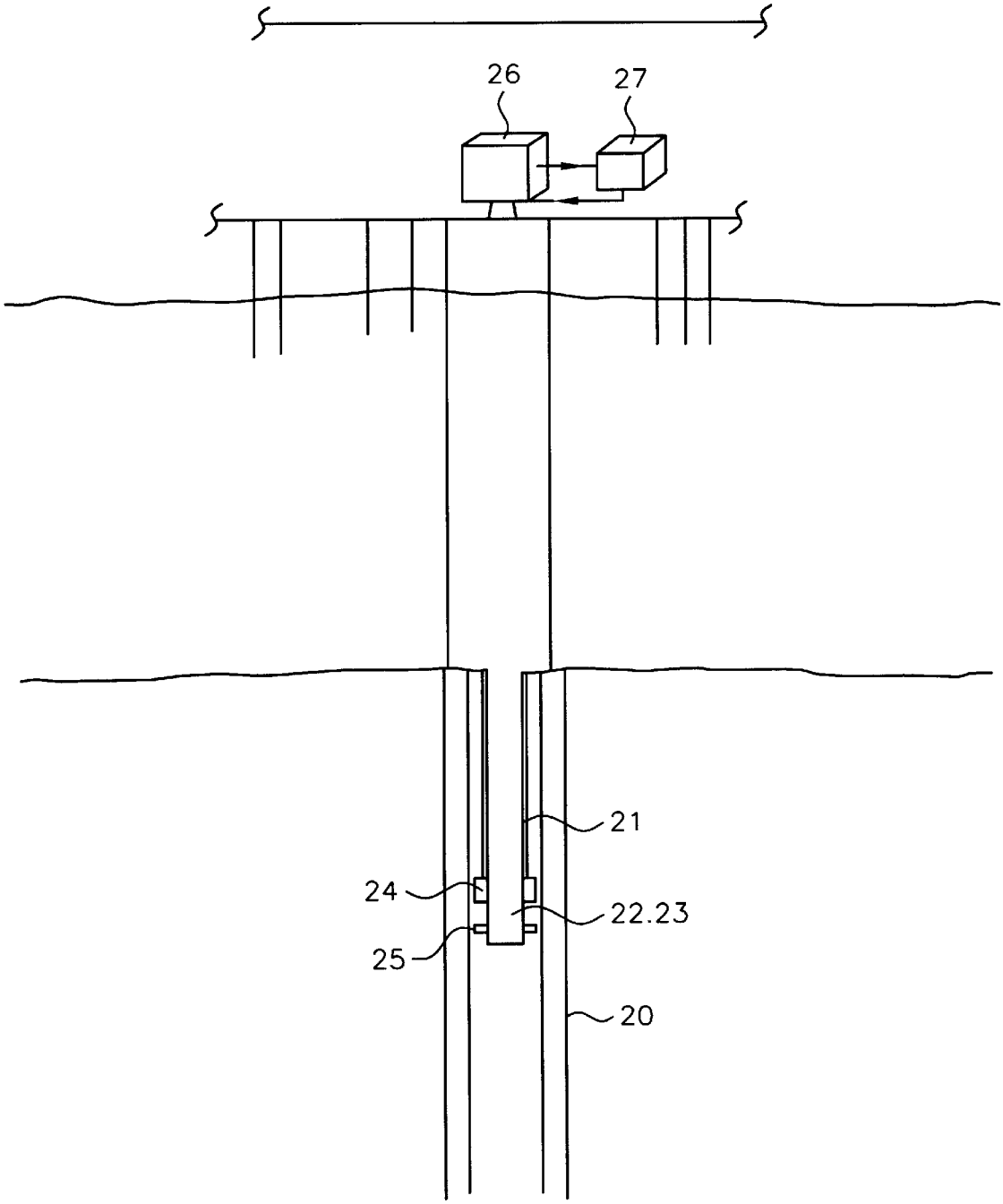
FIG. 3 is a schematic diagram illustrating a well cleanup system.

In FIG. 3 the cleaning system is depicted schematically and in the example there is provided a well 20 with a work string 21 suspended in the well 20. The work string 21 supports a tool 22 comprising of a body member 23, brushes 24 and plunging cup 25.

At the top of the well is provided a vacuum pump 26 which assists by siphoning fluid up the work string 21. The fluid is then passed through filtration means 27 and the clean fluid directed back into the well.

What is claimed is:

1. A method of cleaning a well, the method including the step of running a work string into the well, the work string supporting one or more cleaning members adapted to plunge the well by sealably engaging the well casing such that the majority or substantially all of the well fluid below the one or more cleaning members is caused to flow up a bore or channel provided in the work string to the surface.

2. A method as claimed in claim 1 further including cleaning the well casing by the contact of the cleaning members thereon.

3. A method as claimed in claim 1, further including sucking the well fluid up the work string using a vacuum system or pump.

4. A method as claimed in claim 1, further including filtering the well fluid, preferably at surface and thereafter directing the fluid back into the well.

5. A method as claimed in claim 1 further including pressuring up behind the one or more cleaning members so as to rupture a disc to enable fluid bypass after plunging the well.

* * * * *